US006810532B2

(12) United States Patent
Wang Lee

(10) Patent No.: US 6,810,532 B2
(45) Date of Patent: Nov. 2, 2004

(54) SAFETY HELMET WITH AN AIR DUCT

(76) Inventor: Anthony Wang Lee, No. 473, Chung-Shan S. Rd., Yung-Kang City, Tainan Hsien (TW)

( * ) Notice: Subject to any disclaimer, the term of this patent is extended or adjusted under 35 U.S.C. 154(b) by 3 days.

(21) Appl. No.: 10/401,878

(22) Filed: Mar. 31, 2003

(65) Prior Publication Data

US 2004/0187195 A1 Sep. 30, 2004

(51) Int. Cl.[7] ..... A42C 5/04
(52) U.S. Cl. ..... 2/171.3; 128/200.28; 128/201.24
(58) Field of Search ..... 2/171.3; 128/200.28, 128/201.24, 201.25, 201.23

(56) References Cited

U.S. PATENT DOCUMENTS 3,223,086 A * 12/1965 Denton ..... 128/201.24
3,413,972 A * 12/1968 Depping ..... 128/201.23
4,227,520 A * 10/1980 Lord ..... 128/201.24
4,280,491 A * 7/1981 Berg et al. ..... 128/201.24
4,462,399 A * 7/1984 Braun ..... 128/201.25

FOREIGN PATENT DOCUMENTS

GB 2061696 A * 5/1981 ..... A42B/3/00
GB 2063074 A * 6/1981 ..... A62B/7/10

* cited by examiner

*Primary Examiner*—Rodney M. Lindsey
(74) *Attorney, Agent, or Firm*—Bacon & Thomas

(57) ABSTRACT

A safety helmet includes a hat having an arcuate, elongated recessed area defined in an inner face of the hat and a through hole defined through a periphery of the hat. A lining is detachably connected to the inner face of the hat so as to define an air duct inside the safety helmet.

4 Claims, 5 Drawing Sheets

SAFETY HELMET WITH AN AIR DUCT

BACKGROUND OF THE INVENTION

1. Field of the Invention

The present invention relates to a safety helmet, and more particularly to a safety helmet with an air duct formed inside the safety helmet to allow fresh air to flow into the safety helmet by an air providing device to maintain ventilation inside the safety helmet.

2. Description of Related Art

In a working site, especially a mining site, workers are required to wear safety helmets to protect the safety of the workers. However, because the air inside the confined space in the mining site is stagnant, workers often have to breathe bad quality air. Therefore, working at a mining zone itself is hazardous enough to the workers, let along breathing poor quality air. In order to improve the situation, an air duct device is mounted inside the safety helmet and an air hose is detachably connected to the air duct device inside the safety helmet so that the breathing quality of the workers' air is improved. Because fresh air is pumped to each of the workers via a compressor, workers may always have fresh air to breathe.

Although the air hose and the air duct device connected to the safety helmet do improve the existing safety helmet concerning the breathing problem, the air duct device is individual to the safety helmet so that manufacturer has to produce the air duct device separately, which increases fabrication cost. Besides, every time the workers use the air hose, the workers will have to attach the air duct device first, which brings a lot of inconvenience to the workers.

To overcome the shortcomings, the present invention tends to provide an improved safety helmet to mitigate and obviate the aforementioned problems.

SUMMARY OF THE INVENTION

The primary objective of the present invention is to provide an improved safety helmet with a recessed area defined in an inner face of a hat and a lining configured to mate with the inner face of the hat to define an air duct inside the safety helmet.

Other objects, advantages and novel features of the invention will become more apparent from the following detailed description when taken in conjunction with the accompanying drawings.

DETAILED DESCRIPTION OF THE PREFERRED EMBODIMENT

Figure 1:
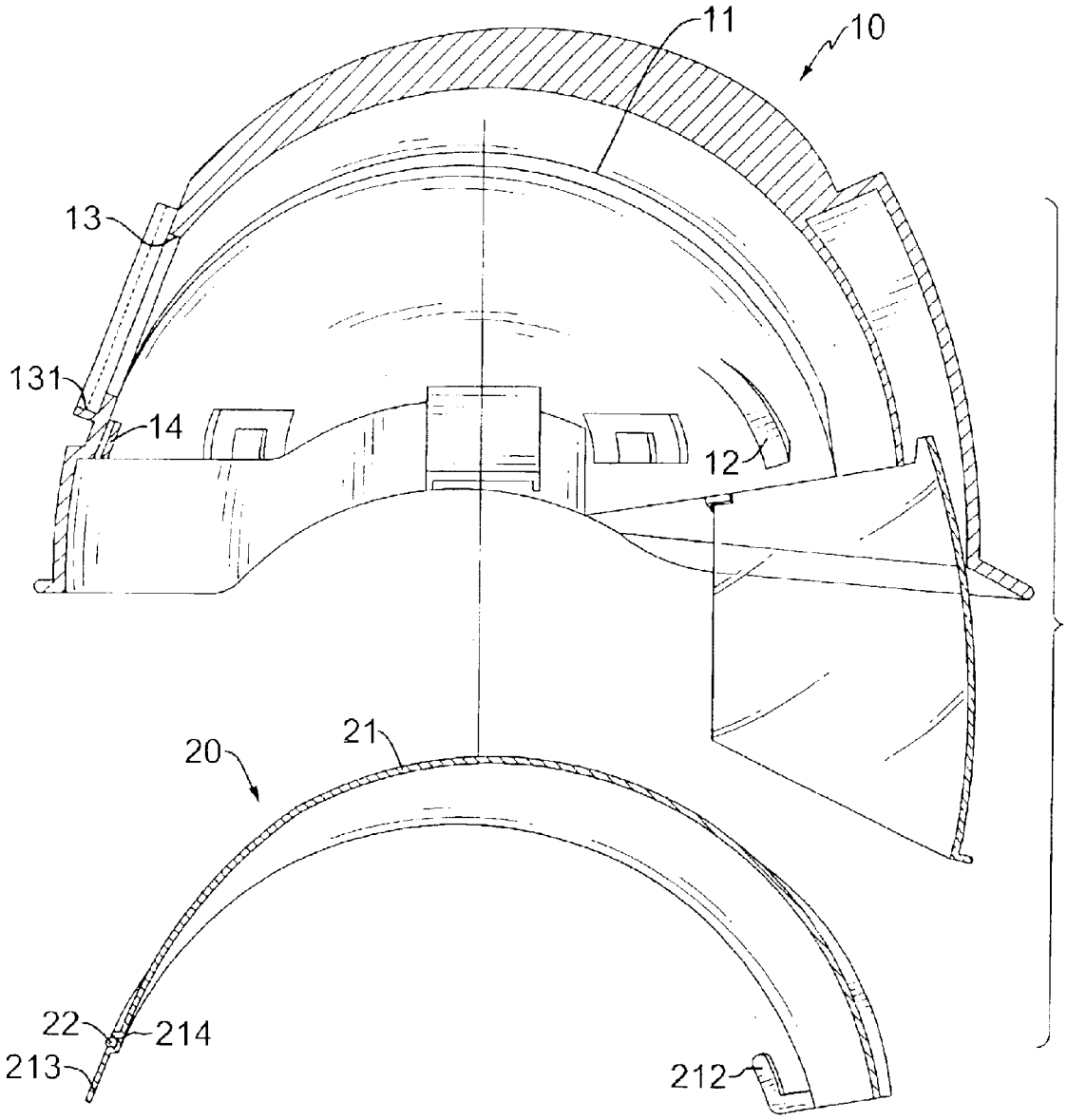
FIG. 1 is an exploded view in partial cross-section of the safety helmet of the present invention.

With reference to FIG. 1, the safety helmet in accordance with the present invention includes a hat (10) and a lining (20).

Figure 2:
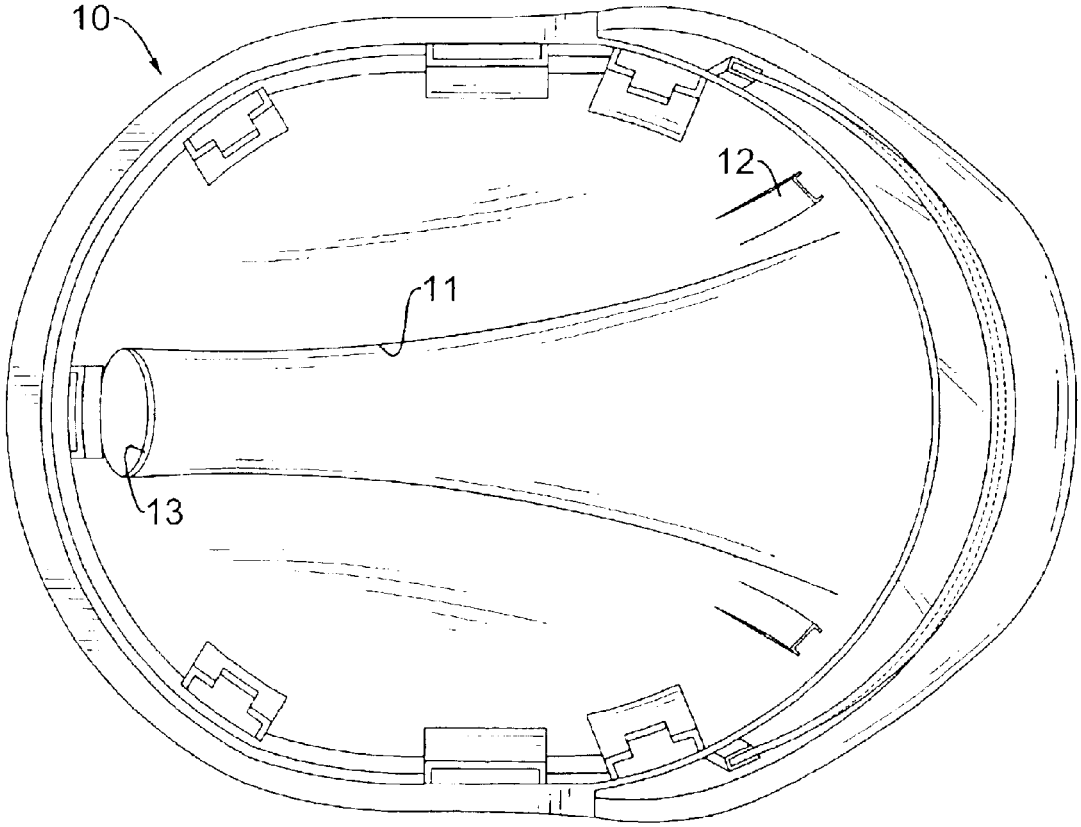
FIG. 2 is a bottom view of a hat of the present invention.

With reference to FIG. 2 and still taking FIG. 1 for reference, the hat (10) has an arcuate, elongated recessed area (11) defined in an inner face of the hat (10). Two positioning recesses (12) are defined at opposite sides of a distal end of the recessed area (11). A through hole (13) is defined through a periphery of the hat (10) to communicate with the recessed area (11). A positioning track (131) is formed on an outer face of the hat (10) and around the through hole (13). A securing recess (14) is defined in the inner face of the hat (10) and sandwiched between a peripheral edge of the hat (10) and the through hole (13).

Figure 3:
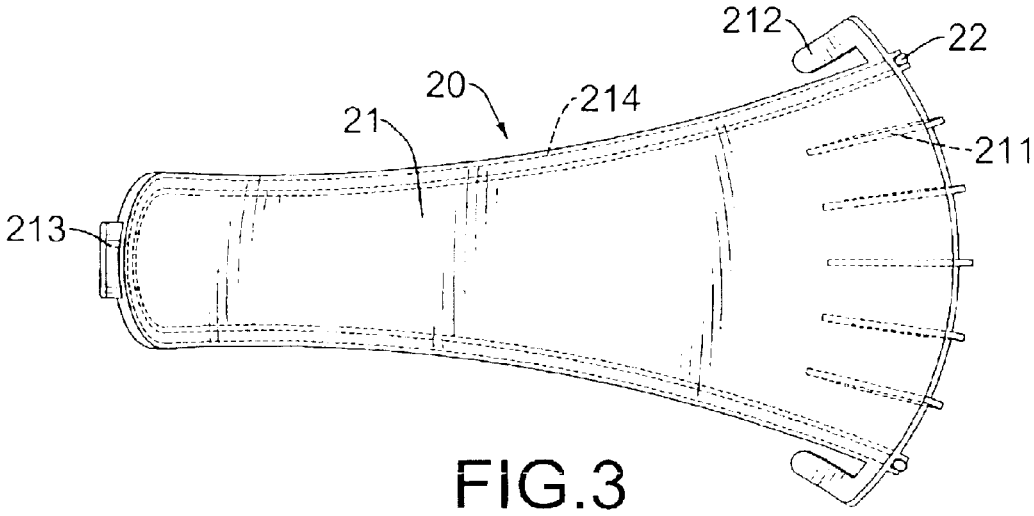
FIG. 3 is a bottom view of the lining of the present invention.

With reference to FIG. 3 and still taking FIG. 1 for reference, the lining (20) has an arcuate body (21) with multiple ribs (211) formed on the arcuate body (21) and extending to a peripheral edge of the arcuate body (21). A positioning extension (212) is formed on opposite sides of the arcuate body (21) to correspond to the positioning recesses (12) of the hat (10). A protrusion (213) is formed on a distal end of the arcuate body (21) to correspond to the securing recess (14). A receiving recess (214) is formed on a peripheral edge of the arcuate body (21) to receive therein a seal (22).

Figure 4:
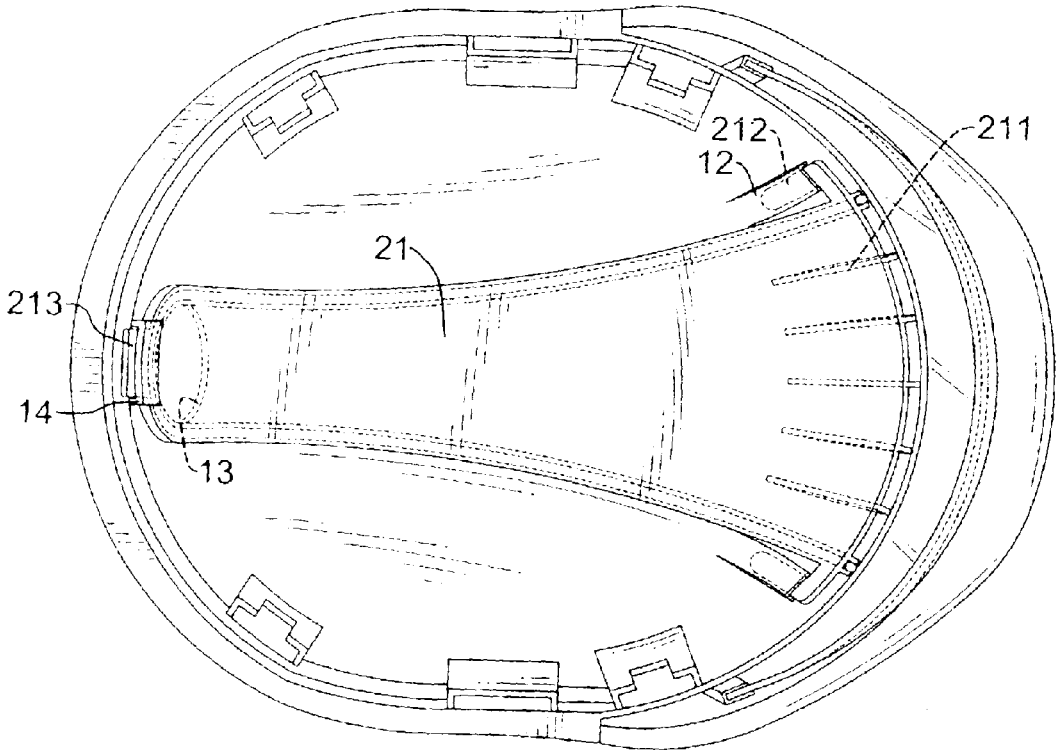
FIG. 4 is a bottom view showing the combination of the lining and the inner face of the hat.

With reference to FIG. 4, when the hat (10) is assembled with the lining (20), the two positioning extensions (212) are inserted into the positioning recesses (12) of the hat (10). Then the protrusion (213) is inserted into a space defined by the securing recess (14). Thereafter the assembly of the safety helmet is finished with the seal (22) of the lining (20) securely engaged with the inner face of the hat (10) around the recessed area (11) in a air-tight manner to form an air duct. It is noted that when the seal (22) engages with the inner face of the hat (10), the ribs (211) of the lining (20) also engage with the inner face of the hat (10) to form multiple air nozzles.

Figure 5:
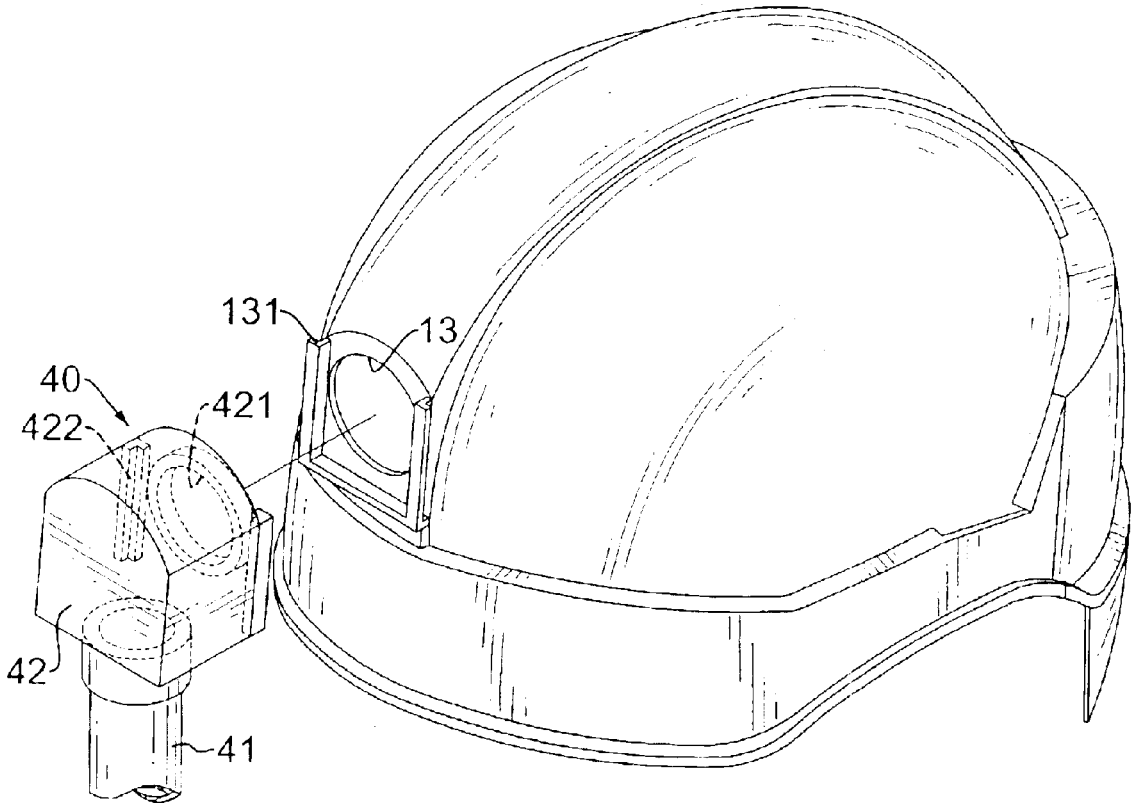
FIG. 5 is a perspective view of the safety helmet used with an air device.
Figure 6:
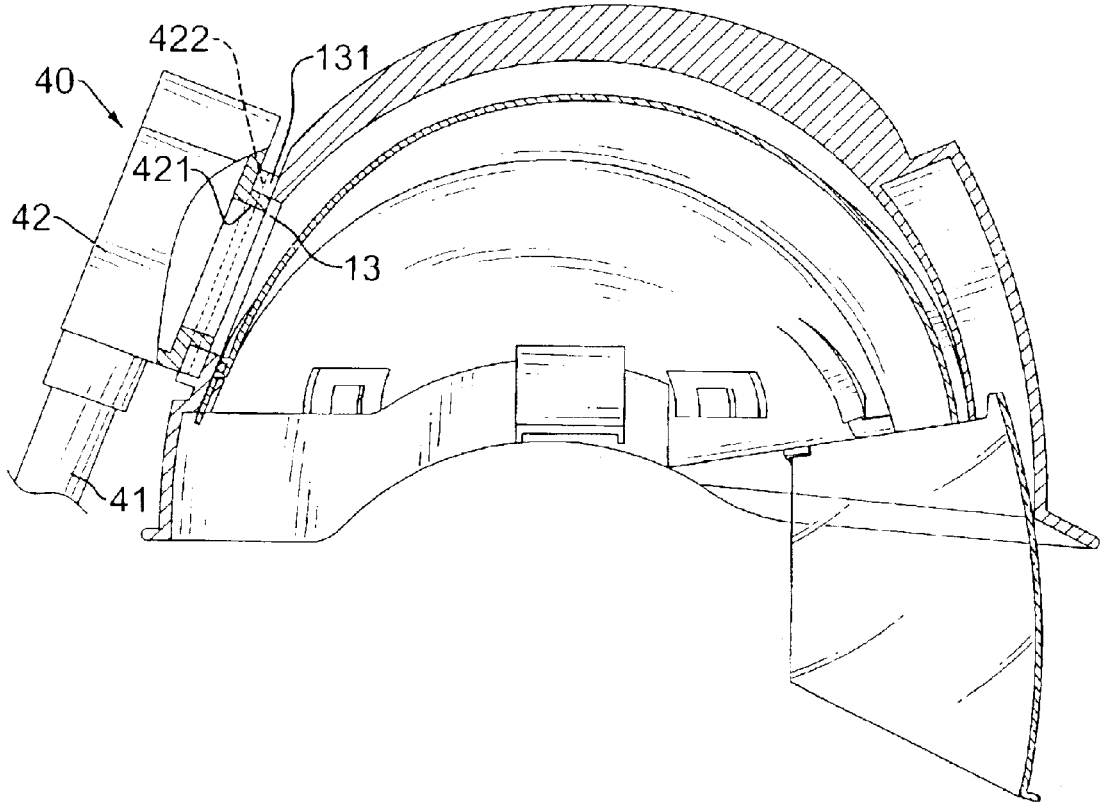
FIG. 6 is a schematic side plan view showing the combination of the safety helmet and the air device.

With reference to FIGS. 5 and 6, the safety helmet of the present invention is adapted to be used with an air providing device (40). The air providing device (40) includes an air hose (41) and a hollow connector (42). The air hose (41) is connected to a compressor (not shown). The hollow connector (42) has an outlet (421) corresponding to the through hole (13). A securing plate (422) extends around opposite sides of the outlet (421) to correspond to the positioning track (131). Therefore, placing the securing plate (422) in the positioning track (131) of the hat (10) secures the connection between the air providing device (40) and the safety helmet of the present invention. When the compressor starts pumping, fresh air is able to flow through the air hose (41) and into the air duct in the safety helmet. Eventually, the fresh air is able to flow out of the safety helmet via the multiple nozzles defined by the ribs (211) and the inner face of the hat (10).

It may be concluded that the safety helmet of the present invention has the following advantages:

Since the air duct is formed inside the safety helmet, users need not attach an air duct device before attaching the air providing device so that the safety helmet is convenient to use.

The air duct is directly formed inside the hat so that cost for manufacturing the safety helmet is decreased.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the fill extent indicated by the broad general meaning of the terms in which the appended claims are expressed.

What is claimed is:

1. A safety helmet comprising:

a hat having an arcuate, elongated recessed area defined in an inner face of the hat and a through hole defined through a periphery of the hat, two positioning recesses defined in opposite sides of the recessed area and a securing recess sandwiched between the through hole and a peripheral edge of the hat; and a lining detachably connected to the inner face of the hat to define an air duct inside the safety helmet, wherein the lining has two positioning extensions oppositely formed to correspond to the positioning recesses and a protrusion formed on a distal end of the lining to correspond to the securing recess so that after inserting the positioning extensions into the positioning recesses and the protrusion into the securing recess, combination between the hat and the lining is finished and the air duct is defined by the arcuate, elongated recessed area and the lining.

2. The safety helmet as claimed in claim 1, wherein the lining has multiple ribs formed on the lining to engage with the inner face of the hat to form multiple nozzles.

3. The safety helmet as claimed in claim 2, wherein the lining has a receiving recess defined along a peripheral edge of the lining to receive therein a seal to engage with the inner face of the hat in an air-tight manner.

4. The safety helmet as claimed in claim 1, wherein the lining has a receiving recess defined along a peripheral edge of the lining to receive therein a seal to engage with the inner face of the hat in an air-tight manner.

* * * * *